US006328399B1

(12) United States Patent
Wen

(10) Patent No.: US 6,328,399 B1
(45) **Date of Patent: *Dec. 11, 2001**

(54) PRINTER AND PRINT HEAD CAPABLE OF PRINTING IN A PLURALITY OF DYNAMIC RANGES OF INK DROPLET VOLUMES AND METHOD OF ASSEMBLING SAME

(75) Inventor: Xin Wen, Rochester, NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/081,984

(22) Filed: May 20, 1998

(51) Int. Cl.[7] ..... B41J 29/38
(52) U.S. Cl. ..... 347/15
(58) Field of Search ..... 347/15, 43, 12, 347/13, 17, 40, 41, 42, 56; 346/104; 358/501

(56) References Cited

U.S. PATENT DOCUMENTS

| | | | | |
|---|---|---|---|---|
| 4,353,079 | | 10/1982 | Kawanabe . | |
| 4,746,935 | | 5/1988 | Allen . | |
| 5,412,410 | * | 5/1995 | Rezanka | 347/15 |
| 5,462,142 | | 10/1995 | Handke et al. . | |
| 5,726,690 | | 3/1998 | Bohorquez et al. . | |

FOREIGN PATENT DOCUMENTS

| | | | | |
|---|---|---|---|---|
| 0 719 647 | | 7/1996 | (EP) . | |
| 58-12764 | * | 1/1983 | (JP) | 347/43 |
| WO 96 32289 | | 10/1996 | (WO) . | |

OTHER PUBLICATIONS

Wen, Printer Apparatus Capable of Varying Direction of an Ink Droplet to be Ejected Therefrom and Method Therefor, USSN 09/036012, filed Mar. 6, 1998.

Sarraf, Continuous Tone Ink–Jet Printhead, USSSN 08/633,277, filed Apr. 16, 1996.

Wen, Ink Jet Printhead for Multi–Level Printing, USSN 08/783,256, filed Jan. 14, 1997.

Wen et al., A Printer Apparatus Adapted to Reduce Cross–Talk Between Ink Channels Therein and Method Thereof, USSN 09/041,121, filed Mar. 17, 1998.

* cited by examiner

*Primary Examiner*—John Barlow
*Assistant Examiner*—Charles W. Stewart, Jr.
(74) *Attorney, Agent, or Firm*—Walter S. Stevens

(57) ABSTRACT

Printer and print head capable of printing in a plurality of dynamic ranges of ink droplet volumes, and method of assembling same. A plurality of first nozzles are connected to a print head body, each first nozzle having a first orifice of a first size for ejecting an ink droplet having a first volume. The ink droplet volume is selected from a first dynamic range of volumes uniquely associated with each first nozzle. A plurality of second nozzles are also connected to the print head body, each second nozzle having a second orifice of a second size larger than the first size of the first nozzles for ejecting an ink droplet therethrough having a second volume larger than the first volume. The second volume is selected from a second dynamic range of volumes, which second dynamic range of volumes may be greater than the first dynamic range of volumes. In this manner, the printer and associated print head body are capable of printing in a plurality of dynamic ranges of volumes, so that a single printer can print either at low density levels or at high density levels with a minimum number of nozzles.

36 Claims, 12 Drawing Sheets

PRINTER AND PRINT HEAD CAPABLE OF PRINTING IN A PLURALITY OF DYNAMIC RANGES OF INK DROPLET VOLUMES AND METHOD OF ASSEMBLING SAME

BACKGROUND OF THE INVENTION

The present invention generally relates to printing apparatus and methods and more particularly relates to a printer and print head capable of printing in a plurality of dynamic ranges of ink droplet volumes, and method of assembling same.

An ink jet printer produces images on a receiver medium by ejecting ink droplets onto the receiver medium in an image-wise fashion. The advantages of non-impact, low-noise, low energy use, and low cost operation in addition to the capability of the printer to print on plain paper are largely responsible for the wide acceptance of ink jet printers in the marketplace.

Thus, ink jet printers are used in a variety of applications. For example, an ink jet printer may be required to print an image having a single density level at 180 dpi (dots per inch) for outdoor signage. This density level for outdoor signage is aesthetically acceptable because such images are typically viewed from a relatively long distance (e.g., 30 feet or 9.14 meters) away from the image. Ink jet printers are also called upon to print relatively high quality images having 16 density levels at 1440 dpi, such as in the case of 8 by 10 inch (20.32 by 25.4 centimeters) photographs. This density level for photographs is aesthetically desirable because photographs are typically viewed from a relatively short distance (e.g., 6 inches or 15.24 centimeters) away from the viewer.

However, available ink jet printers are not capable of printing both low density and high density ranges. The terminology "dynamic range" is commonly defined in the art to mean the range of minimum ink droplet volume to the maximum ink droplet volume which is provided by one ink nozzle. That is, each individual ink jet printer possesses a density range particularly suited for its intended use. For example, an ink jet printer used for signage typically has a density range different from the density range of an ink jet printer used for photographs. Clearly, for purposes of economy, it is desirable to have the same ink jet printer print in both low density and high density ranges.

Ink jet printers having continuous tone to high resolution printing performance are known. One such printer is disclosed in U.S. Pat. No. 5,412,410 titled "Ink Jet Printhead For continuous Tone And Text Printing" issued May 2, 1995, in the name of Ivan Rezanka. The Rezanka device provides a thermal ink jet print head both for continuous tone printing and high resolution printing by controlling the area covered by the ink at each pixel location of the printed image. The print head includes at least two different groups of differently sized nozzles from which ink droplets of different ink volumes are selectively ejected. Thus, according to the Rezanka patent, nozzles of one group, or both groups, may be selectively used to print continuous tone and/or high resolution text.

However, certain printing applications require a range of 16 to 256 different ink droplet volumes and it does not appear that the Rezanka device is capable of ejecting 16 to 256 different ink droplet volumes in a suitable manner. That is, it appears that the Rezanka device requires 16 to 256 nozzle groups to print 16 to 256 ink droplet volumes for a pixel in an image. Manufacturing such a great number of nozzles increases manufacturing and assembly costs of the printer and associated print head. Also, the Rezanka device appears to permit only a relatively small number of nozzles of a given nozzle diameter within each nozzle group. That is, it appears from the Rezanka disclosure that if a total of 256 nozzles having 256 nozzle sizes are present in a print head, there is only one nozzle for each nozzle diameter.

Moreover, it is known that the nozzle diameter may only be varied in a limited range to permit effective ink droplet ejection. In this regard, if the nozzle diameter is tool large, ink tends to inadvertently seep-out the nozzle. On the other hand, if the nozzle diameter is too small, viscosity forces acting at the nozzle wall will be too high for ink ejection. This limitation in variation of nozzle diameter further reduces the range of ink drop volumes that can be provided by prior art devices, such as the Rezanka device. Therefore, a problem in the art is limited range of ink drop volumes produced by ink jet printers.

Therefore, there has been a long-felt need to provide a printer and print head capable of printing in a plurality of dynamic ranges of ink droplet volumes, and method of assembling the printer and print head.

SUMMARY OF THE INVENTION

An object of the present invention is to provide a printer and print head capable of printing in a plurality of dynamic ranges of ink droplet volumes, so that the number of ink ejection nozzles are minimized, and method of assembling the printer and print head.

With this object in view, the present invention resides in a printer, comprising a print head body; a first nozzle connected to said print head body, said first nozzle having a first nozzle orifice of a first size for ejecting fluid therethrough having a first volume selected from a first dynamic range of volumes associated with said first nozzle; and a second nozzle connected to said print head body, said second nozzle having a second nozzle orifice of a second size different from the first size of the first orifice for ejecting fluid therethrough having a second volume different from the first volume, the second volume being selected from a second dynamic range of volumes associated with said second nozzle, the second dynamic range of volumes being substantially different from the first dynamic range of volumes.

In one embodiment of the invention, a plurality of first nozzles are connected to a print head body, each first nozzle having a first orifice of a first size for ejecting an ink droplet having a first volume. The ink droplet volume is selected from a first dynamic range of volumes. The terminology "dynamic range" is defined herein to mean the range of minimum ink droplet volume to the maximum ink droplet volume which is provided by one ink nozzle. The first dynamic range of volumes is uniquely associated with each first nozzle. A plurality of second nozzles are also connected to the print head body, each second nozzle having a second orifice of a second size larger than the first size of the first nozzles for ejecting an ink droplet therethrough having a second volume larger than the first volume. The second volume is selected from a second dynamic range of volumes. The second dynamic range of volumes is uniquely associated with each second nozzle. Moreover, the second dynamic range of volumes is substantially different from the first dynamic range of volumes. For example, the second dynamic range of volumes may be greater than the first dynamic range of volumes.

In addition, the first nozzles are arranged to define a first nozzle row and the second nozzles are arranged to define a second nozzle row adjacent the first nozzle row, so that the first nozzles defining the first row are co-linearly aligned with respective ones of the second nozzles defining the second row. Alternatively, the first nozzles can be arranged to define the first nozzle row and the second nozzles can be arranged to define the second nozzle row adjacent the first nozzle row, such that the first nozzles defining the first row are off-set relative to respective ones of the second nozzles defining the second row.

A feature of the present invention is the provision of a nozzle plate comprising nozzles having nozzle orifices arranged in rows according to orifice size, so that orifices of the same size are assigned to the same row of orifices.

Another feature of the present invention is the provision of a nozzle plate, wherein one nozzle orifice from each row of nozzles define a pixel group, the nozzle orifices defining the pixel group are adjacent to each other.

An advantage of the present invention is that dynamic range in ink droplet volume provided by each pixel group is significantly larger than what is provided by prior art thermal ink jet printers.

Another advantage of the present invention is that when a relatively wide density range is required, enablement of all nozzles in a pixel group can provide a maximum dynamic range in ink droplet volume.

Yet another advantage of the present invention is that a first nozzle row and a second nozzle row can each provide 4 bits of volume variation with respect to ink droplet volume, so that 8 bits of volume variation is obtained when both the first and second nozzles are used in combination.

Still another advantage of the present invention is that the printer is capable of printing images at high speed and low resolution in a single bit density variation (i.e., halftone images) which is suitable for signs viewed from a relatively long distance. In addition, the same printer can also print in multi-bit density levels at high resolution, which is suitable for viewing photographic quality images.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1A:
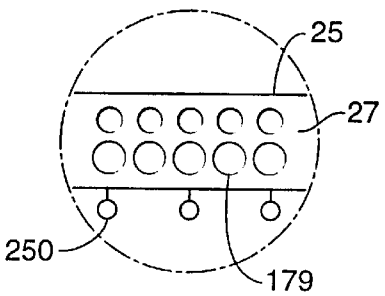
FIG. 1A is a magnified view of the print head.
Figure 1:
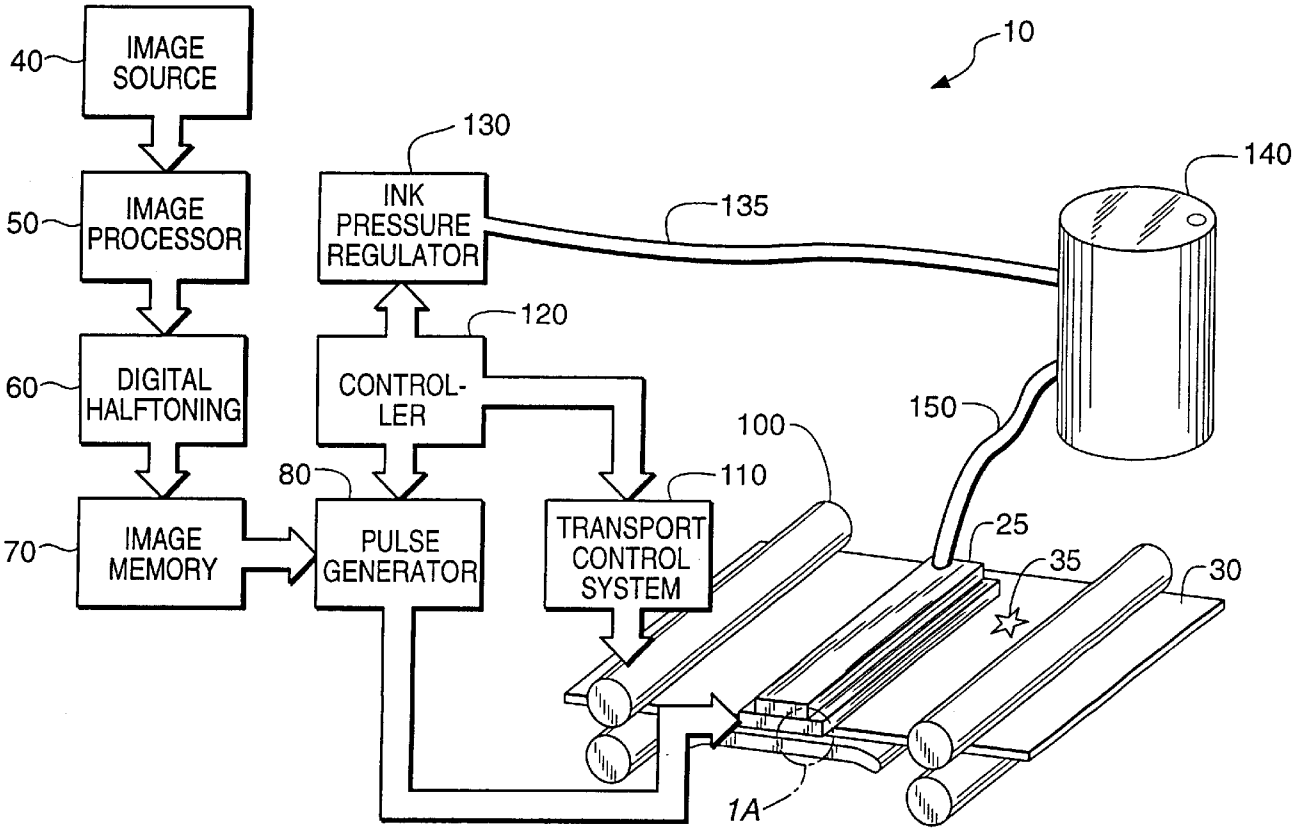
FIG. 1 is a schematic of a printer belonging to the present invention, the printer including a print head.

Therefore, referring to FIGS. 1 and 1A there is shown a printer, generally referred to as 10, capable of printing in a plurality of dynamic ranges of ink droplet volume. In this regard, printer 10 is capable of ejecting an ink droplet 20 (see FIG. 5) from a print head 25 toward a receiver 30 in order to form an image 35 on receiver 30. Receiver 30 may be a reflective-type (e.g., paper) or transmissive-type (e.g., transparency) receiver. Print head 25 includes a generally cuboid-shaped preferably one-piece print head body 27 (see FIG. 2), as disclosed more fully hereinbelow. As used herein, the terminology "dynamic range" means the range of minimum ink droplet volume to the maximum ink droplet volume which is provided by one ink nozzle.

As shown in FIG. 1, printer 10 comprises an image source 40, which may be raster image data from a scanner or computer, or outline image data in the form of a PDL (Page Description Language) or other form of digital image representation. This image data is transmitted to an image processor 50 connected to image source 40. In this regard, image processor 50 converts the image data to a pixel-mapped page image. Image processor 50 may be a raster image processor in the case of PDL image data to be converted, or a pixel image processor in the case of raster image data to be converted. In any case, image processor 50 transmits continuous tone data to a digital halftoning unit 60 connected to image processor 50. Halftoning unit 60 halftones the continuous tone data produced by image processor 50 and produces halftoned bitmap image data that is stored in an image memory 70, which may be a full-page memory or a band memory depending on the configuration of printer 10. A pulse generator 80 connected to image memory 70 reads data from image memory 70 and applies time and amplitude varying voltage pulses to an electrical actuator 90 (see FIG. 2), for reasons described more fully hereinbelow.

Referring again to FIG. 1, receiver 30 is moved relative to print head 25 by means of a transport mechanism 100, which is electronically controlled by a transport control system 110. Transport control system 110 in turn is controlled by a suitable controller 120. It may be appreciated that different mechanical configurations for transport control system 110 are possible. For example, in the case of pagewidth print heads, it is convenient to move receiver 30 past a stationary print head 25. On the other hand, in the case of scanning-type print systems, it is more convenient to move print head 25 along one axis (i.e., a sub-scanning direction) and receiver 30 along an orthogonal axis (i.e., a main scanning direction), in a relative raster motion. In addition, controller 120 may be connected to an ink pressure regulator 130 for controlling regulator 130. Regulator 130, if present, is connected to an ink reservoir 140, such as by means of a first conduit 135, for regulating pressure in ink reservoir 140. Ink reservoir 140 is connected, such as by means of a second conduit 150, to print head 25 for supplying ink to print head 25.

Figure 2:
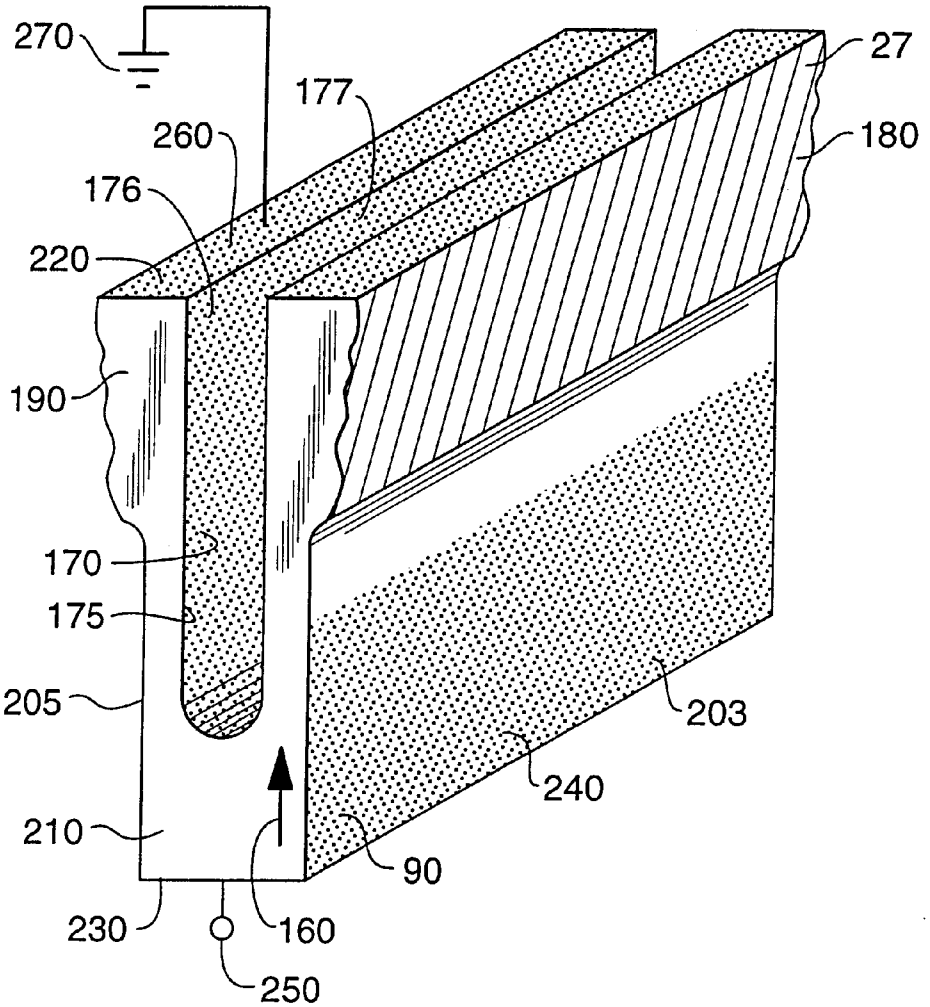
FIG. 2 is a fragmentation view in perspective of an individual ink channel belonging to the print head.
Figure 3:
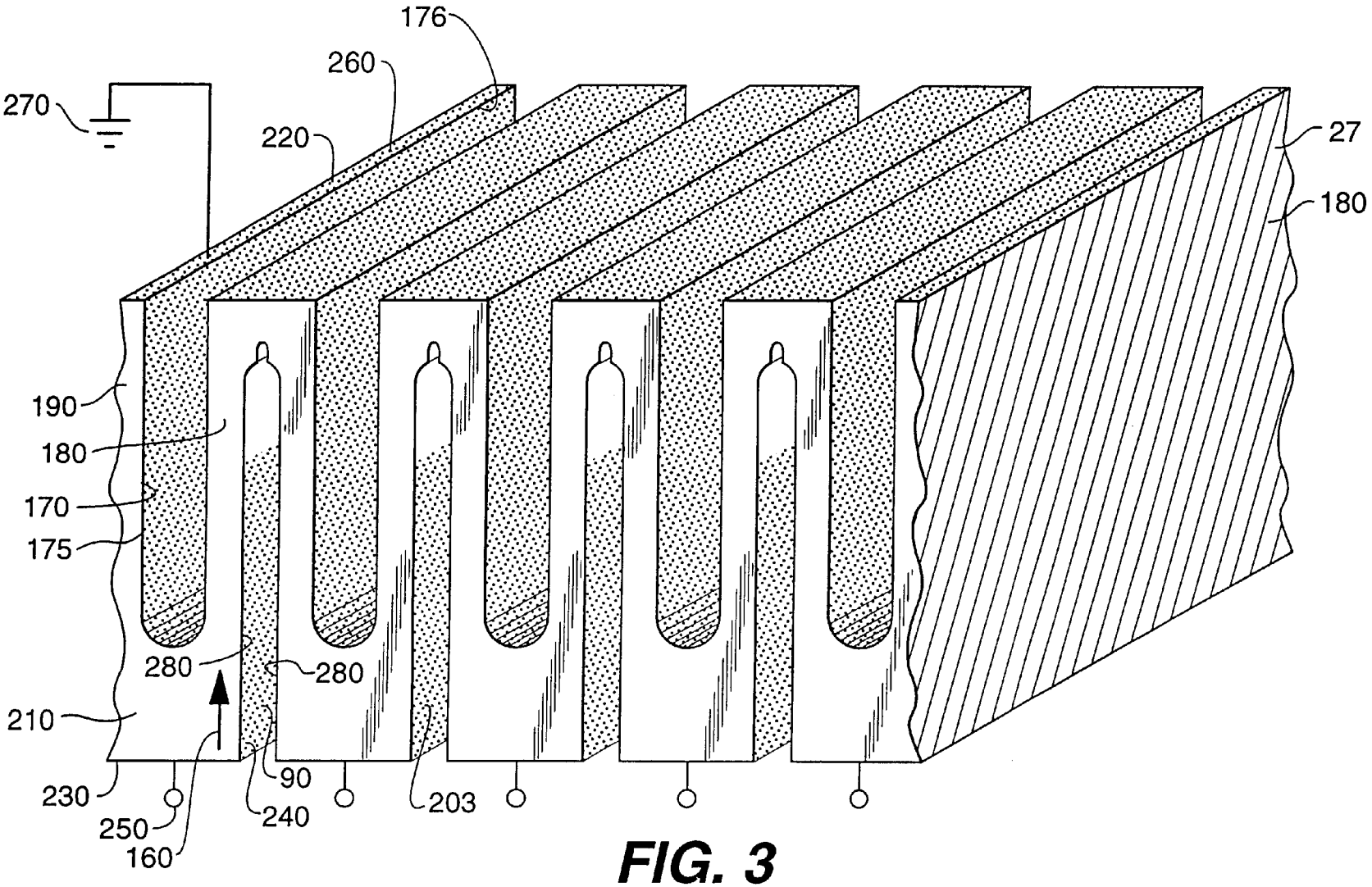
FIG. 3 is a fragmentation view in perspective of a print head body having a plurality of the ink channels and cut-outs between ink channels.
Figure 4A:
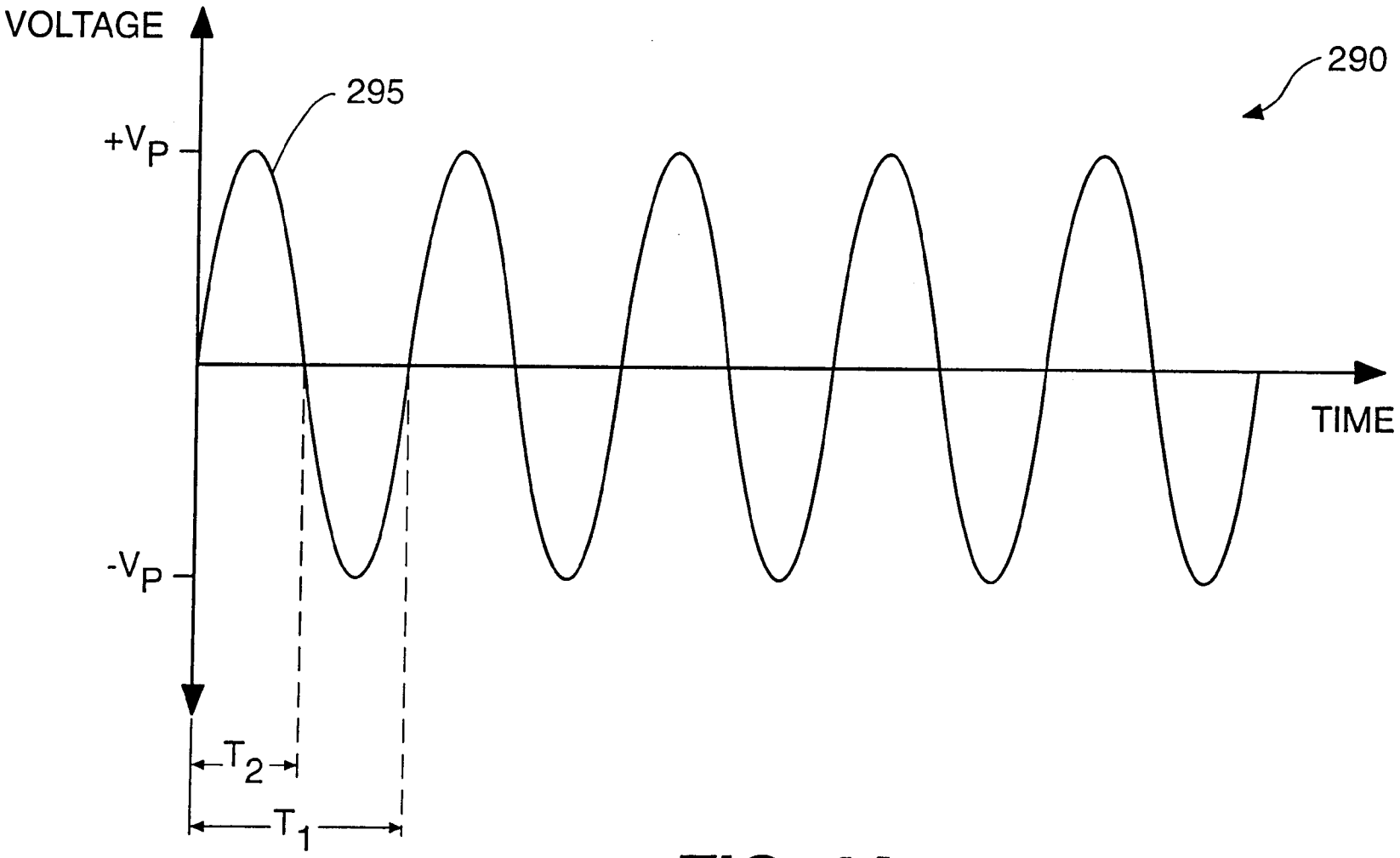
FIG. 4A is a graph illustrating an electrical pulse burst comprising a plurality of voltage pulses as a function of time, the voltage pulses having identical voltage amplitude and period.
Figure 4B:
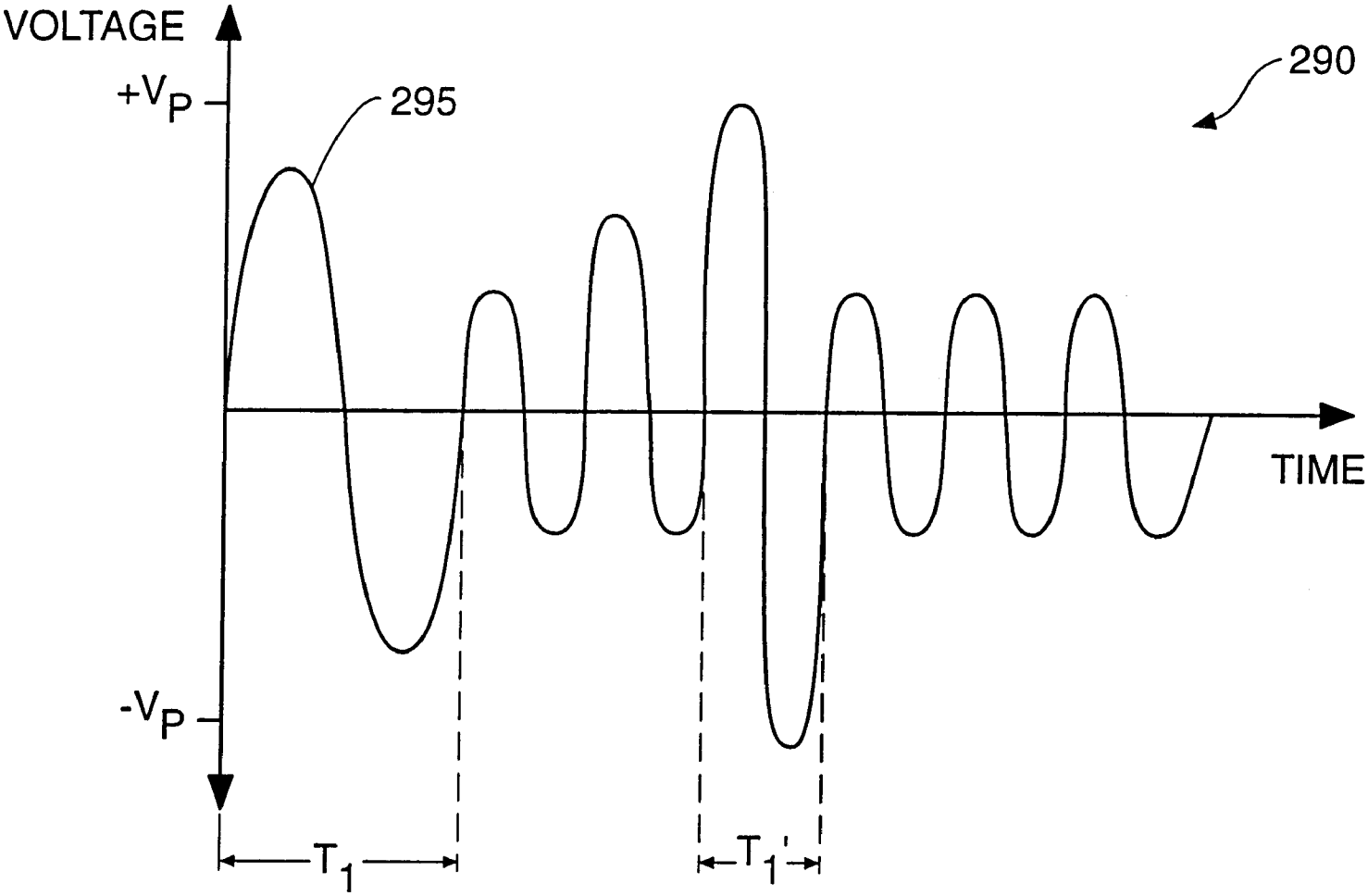
FIG. 4B is a graph illustrating an electrical pulse burst comprising a plurality of voltage pulses as a function of time, the voltage pulses having voltage amplitude and period different for each pulse.
Figure 4C:
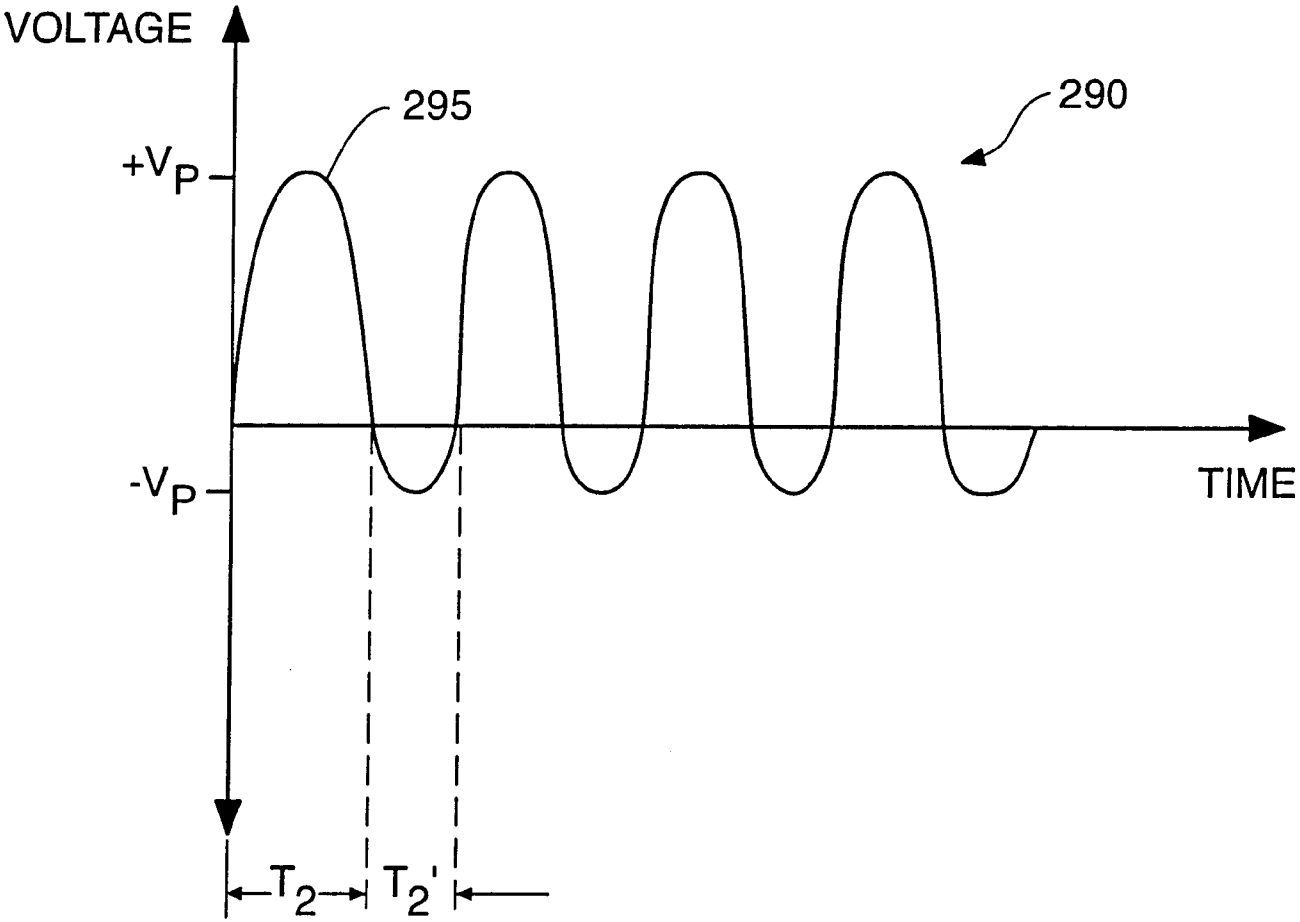
FIG. 4C is a graph illustrating an electrical pulse burst comprising a plurality of voltage pulses as a function of time, the voltage pulses having different voltage amplitude for each half period.
Figure 4D:
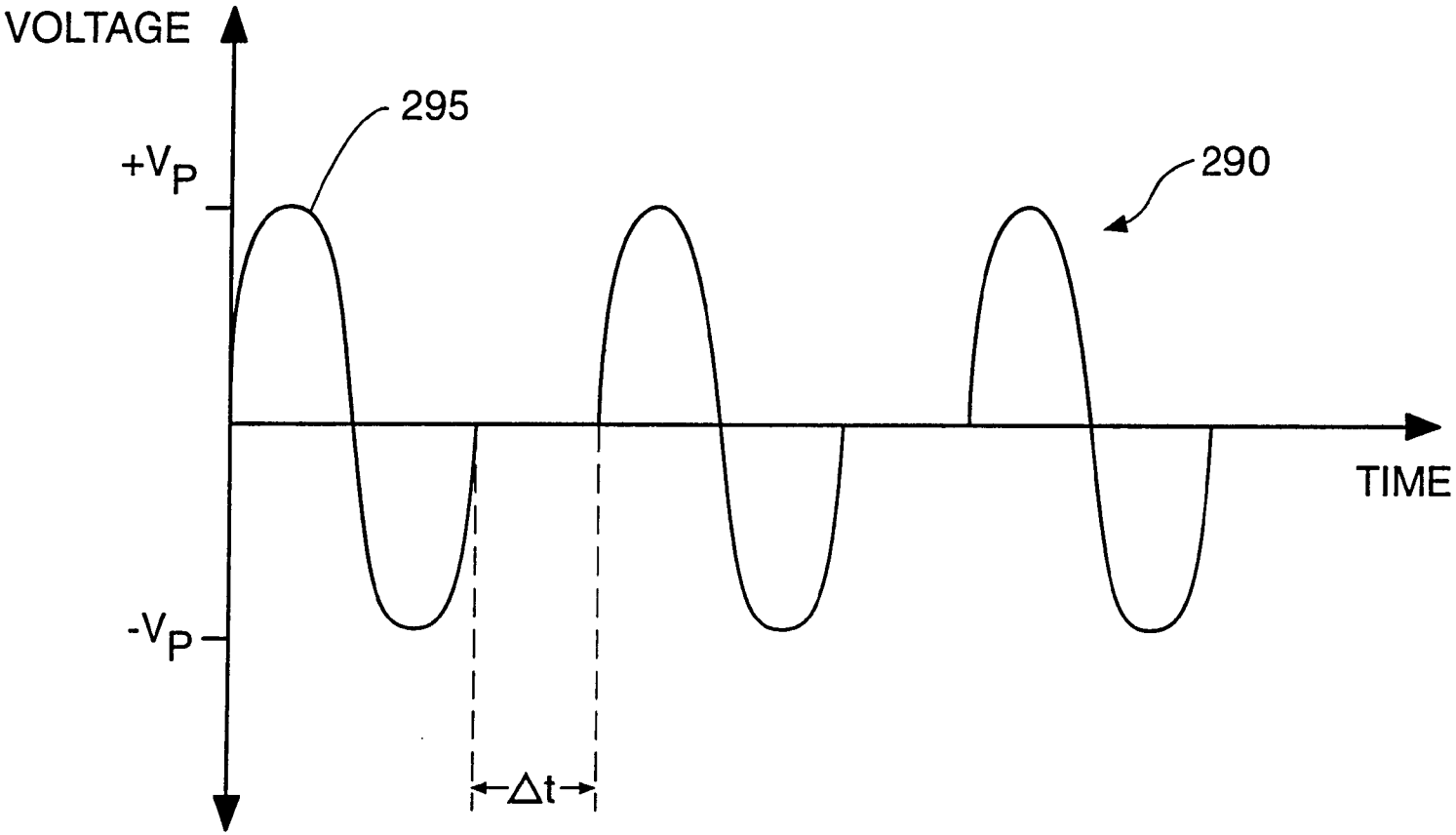
FIG. 4D is a graph illustrating three electrical pulse bursts as a function of time, each pulse burst comprising a single pulse and the voltage pulses being separated by a time delay.
Figure 4E:
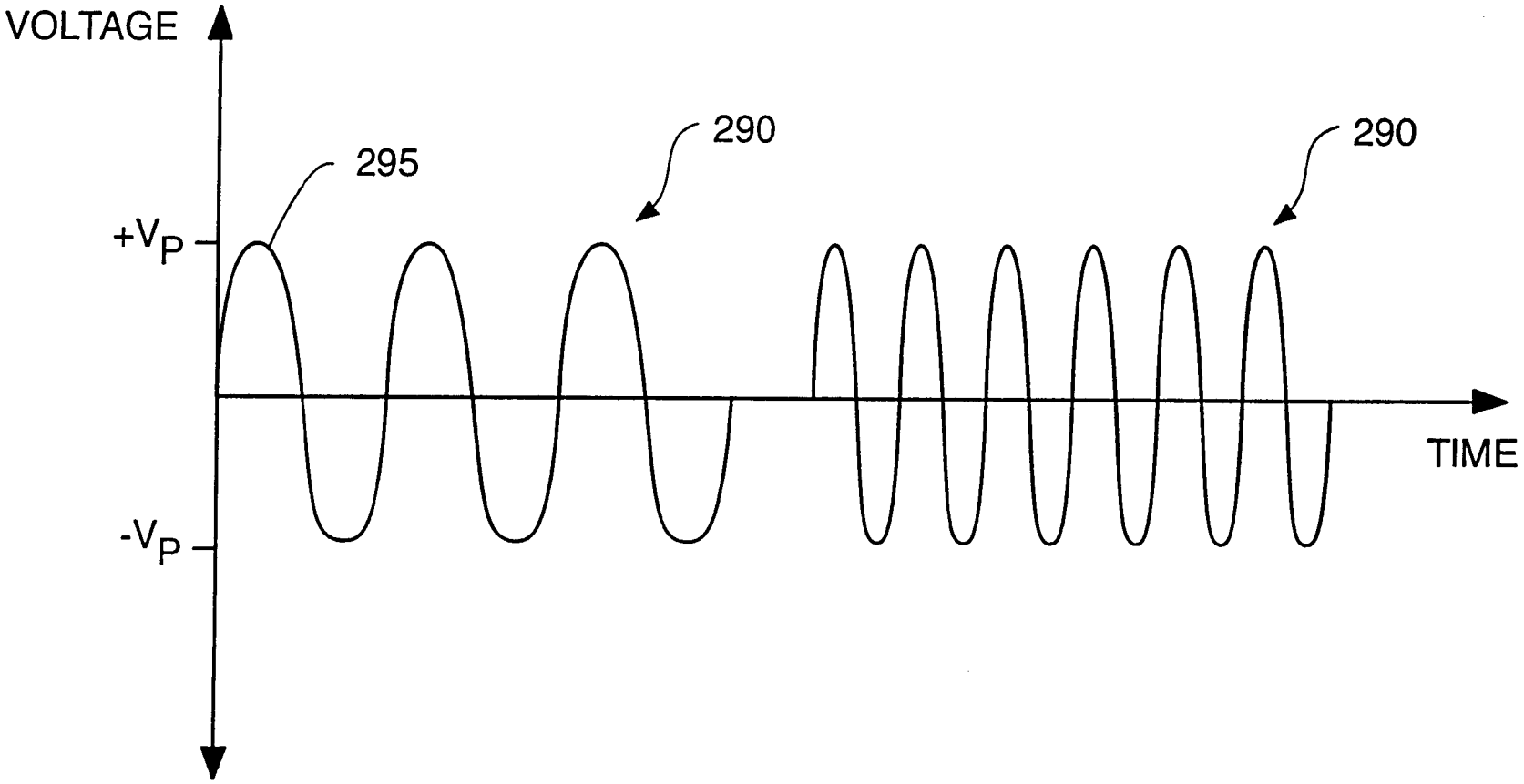
FIG. 4E is a graph illustrating two electrical pulse bursts as a function of time, each pulse burst comprising a plurality of voltage pulses wherein number of pulses in each Pulse burst is different.

Referring to FIGS. 2 and 3, print head 25 comprises the previously mentioned generally cuboid-shaped preferably one-piece print head body 27 formed of a piezoelectric material. The piezoelectric material, such as lead zirconium titanate (PZT), is responsive to electrical stimuli. In the preferred embodiment of the invention, piezoelectric print head body 27 is "poled" generally in the direction of an arrow 160. Of course, the poling direction may be oriented in other directions, if desired, such as in a direction perpendicular to the poling direction shown by arrow 160.

Still referring to FIGS. 2 and 3, cut into print head body 27 are a plurality of elongate ink channels 170. Each of the channels 170 has a channel outlet 175 at an end 176 thereof and an open side 177. Ink channels 170 are covered at outlets 175 by a first embodiment nozzle plate 178 (see FIG. 5) having a plurality of orifices 179 of predetermined diameter aligned with respective ones of channels 170, so that ink droplets 20 are ejected from channels 170 and through their respective orifices 179. With reference to FIGS. 2 and 3, a rear cover plate (not shown) is also provided for capping the rear of channels 175. In addition, a top cover plate (not shown) caps chambers 170 along open side 177. During operation of printer 10, ink from reservoir 140 is controllably supplied to each channel 175 by means of second conduit 150.

As best seen in FIG. 2, print head body 27 includes a first side wall 180 and a second side wall 190 defining channel 170 therebetween, which channel 170 is adapted to receive liquid ink body 200 (see FIG. 6) therein. As shown in FIG. 2, first side wall 180 has an outside surface 203 and second side wall 190 has an outside surface 205. Print head body 27 also includes a base portion 210 interconnecting first side wall 180 and second side wall 190, so as to form a generally U-shaped structure comprising the piezoelectric material. Upper-most surfaces (as shown) of first side wall 180 and second side wall 190 together define a top surface 220 of print head body 27. A lower-most surface (as shown) of base portion 210 defines a bottom surface 230 of print head body 27. An addressable electrode actuator layer 240 may extend from approximately half-way up outside surface 203 of first side wall 180, across bottom surface 230 to approximately half-way up outside surface 195. In this configuration of electrode actuator layer 240, an electrical field "E" (not shown) is established in a predetermined orientation with respect to poling direction 160, as described in more detail hereinbelow. Moreover, electrode actuator layer 240 is connected to the previously mentioned pulse generator 80. Pulse generator 80 supplies electrical drive signals to electrode actuator layer 240 via an electrical conducting terminal 250 interconnecting pulse generator 80 and actuator layer 240.

Referring yet again to FIG. 2, a common electrode layer 260 coats each channel 170 and also extends therefrom along top surface 220. Common electrode layer 260 is preferably connected to a ground electric potential, as at a point 270. Alternatively, common electrode layer 290 may be connected to pulse generator 80 for receiving electrical drive signals therefrom. However, it is preferable to maintain common electrode layer 260 at ground potential because common electrode layer 260 is in contact with liquid ink body 200 in channel 170. That is, it is preferable to maintain common electrode layer 260 at ground potential in order to minimize electrolysis effects on common electrode layer 260 when in contact with liquid ink body 200 in channel 170, which electrolysis may otherwise act to degrade performance of common electrode layer 260 as well as the ink.

As best seen in FIG. 3, each pair of "neighboring" ink channels 170 is separated by a cut-out 280, which may be filled with air or a resilient elastomer (not shown), for reducing mechanical "cross-talk" between channels 170. Such cross-talk between the channels 170 would otherwise interfere with precise ejection of ink droplets 20 from channels 170. Each cut-out 280 is defined between respective pairs of side walls 180/190, so that channels 170 are mechanically decoupled by presence of cut-outs 280. It should be apparent from the description herein that the terminology "neighboring" ink channels means ink channels 170 that would otherwise be adjacent but for intervening cut-out 280.

Referring to FIGS. 1, 2, 3, 4, 4A, 4B, 4C, 4D and 4E, pulse generator 80 generates an electrical drive signal comprising an electrical pulse burst 290 which is supplied to electrode actuator layer 240 by means of electrical conducting terminal 250. Pulse burst 290, which may comprise a plurality of sinusoidal pulses 295, has a predetermined peak voltage amplitude $V_p$ (either positive or negative) and a period $T_1$. Print head body 27, which is responsive to the electrical stimuli supplied to electrode actuator layer 240 by generator 80 deforms when pulse burst 290 is applied, so that first side wall 180 and second side wall 190 simultaneously inwardly move toward each other. Moreover, base portion 210 will likewise inwardly move, as the electrical stimuli is supplied to actuator 240. That is, first side wall 180, second side wall 190 and base portion 210 move due to the inherent nature of piezoelectric materials, such as the piezoelectric material forming print head body 27. In this regard, it is known that when an electrical signal is applied to a piezoelectric material, mechanical distortion occurs in the piezoelectric material. This mechanical distortion is dependent on the poling direction and the direction of the applied electrical field "E" (not shown). Thus, according to the present invention, the previously mentioned electric field "E" is established between electrode actuator layer 240 and common electrode layer 260 and is in a direction generally parallel to poling direction 160 near base portion 210 in order to cause base portion 210 to deform and compress in non-shear mode. In addition, electric field "E" is in a direction generally perpendicular to poling direction 160 near side walls 180/190 to cause side walls 180/190 to deform in shear mode. That is, side walls 180/190 will deform into a generally parallelogram shape, rather than the compressed shape in which base portion 210 deforms. In this manner, print head body 27 becomes longer and thinner in a direction parallel to poling direction 160. Once pulse burst 290 ceases, side walls 180/190 and base portion 210 return to their undeformed positions to await further electrical excitation. However, it may be appreciated that, due to the inherent nature of piezoelectric materials, an applied voltage of one polarity (i.e., either positive or negative polarity, "$+V_p$" or "$-V_p$", respectively) will cause print head body 27 to bend in a first direction and an applied voltage of the opposite polarity (i.e., either positive or negative polarity "$+V_p$" or "$-V_p$", respectively) will cause print head body 27 to deform in a second direction opposite the first direction. It may be appreciated that peak voltage amplitude, either +Vp or −Vp, and periods $T_1$ may be identical for each pulse 295 (see FIG. 4A). Having identical peak voltage amplitude and period $T_1$ is often preferred because it simplifies manufacture and assembly of electronics that provide electrical drive signals to actuator layer 240. Alternatively, it may be appreciated that peak voltage amplitude, either +Vp or −Vp, and periods $T_1$ and $T_1'$ may be different for each pulse 295 (see FIG. 4B). Having different peak voltage amplitudes and periods $T_1$ and $T_1'$ provides flexibility in producing individual microdroplets (not shown) within a burst of ink droplets 20. Such microdroplets may combine in flight to produce a macrodroplet which is deposited on receiver 30. Alternatively, it may be appreciated that peak voltage amplitudes, either +Vp or −Vp, may be different for each half period $T_2$ and $T_2'$ (see FIG. 4C). Having different peak voltage amplitudes for each half period $T_2$ provides even more flexibility in compressing and expanding first and second side walls 180/190 of ink channels 170. In this manner, actuation forces for compressing (i.e., inwardly moving) and expanding (i.e., outwardly moving) first and second side walls 180/190 do not have to be identical for each half-period $T_2$ and $T_2'$. In addition, it may be appreciated that a time delay "Δt" may be inserted between pulses 295, if desired, to spatially separate the microdroplets (see FIG. 4D). As another alternative, the number of pulses 295 in each pulse burst 290 can be varied, if desired, so that number of microdroplets are varied within each burst of ink droplets (see FIG. 4E). In the preferred embodiment of the invention, there are 1 to 16 pulses in a single pulse burst 290 to provide a relatively wide dynamic range in the ejected ink droplet volume with relatively high productivity. Also, a series of "n" micro-droplets can be ejected from nozzles print head 25 when driven by a burst of "n" pulses. Such micro-droplets (not shown) combine into a macro-droplet (i.e., droplet 20) which in turn is deposited onto receiver 30. In the preferred embodiment of the invention, one micro-droplet corresponds to a droplet volume of approximately 1 pl.

Figure 5:
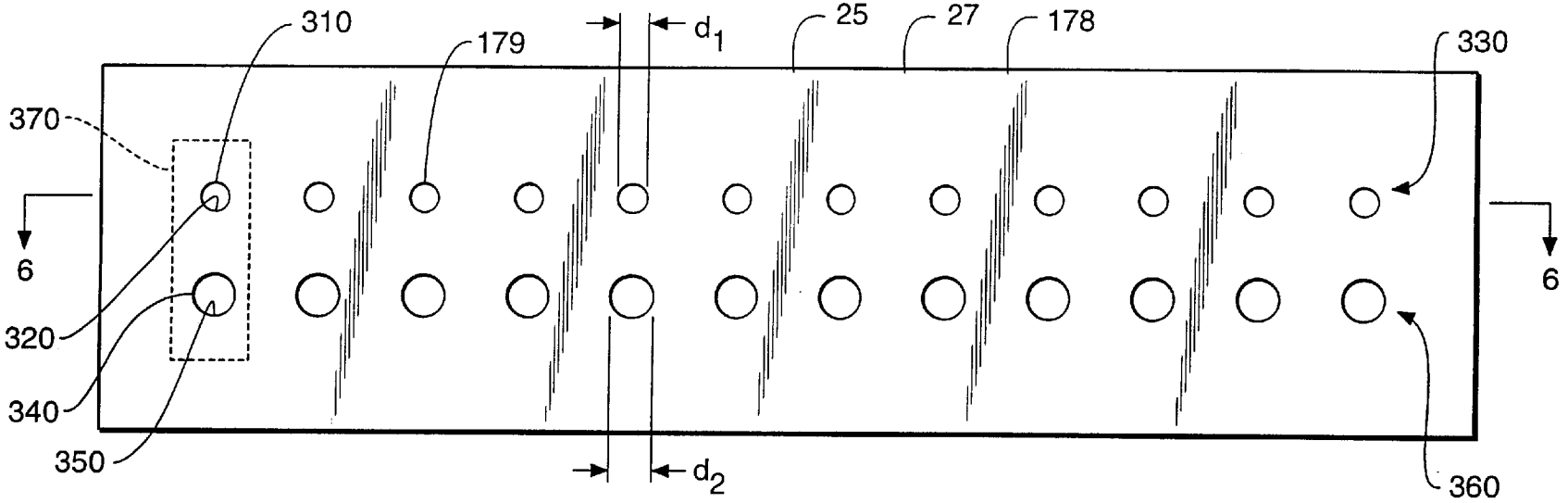
FIG. 5 is a view in elevation of a nozzle plate belonging to a first embodiment of the invention.
Figure 6:
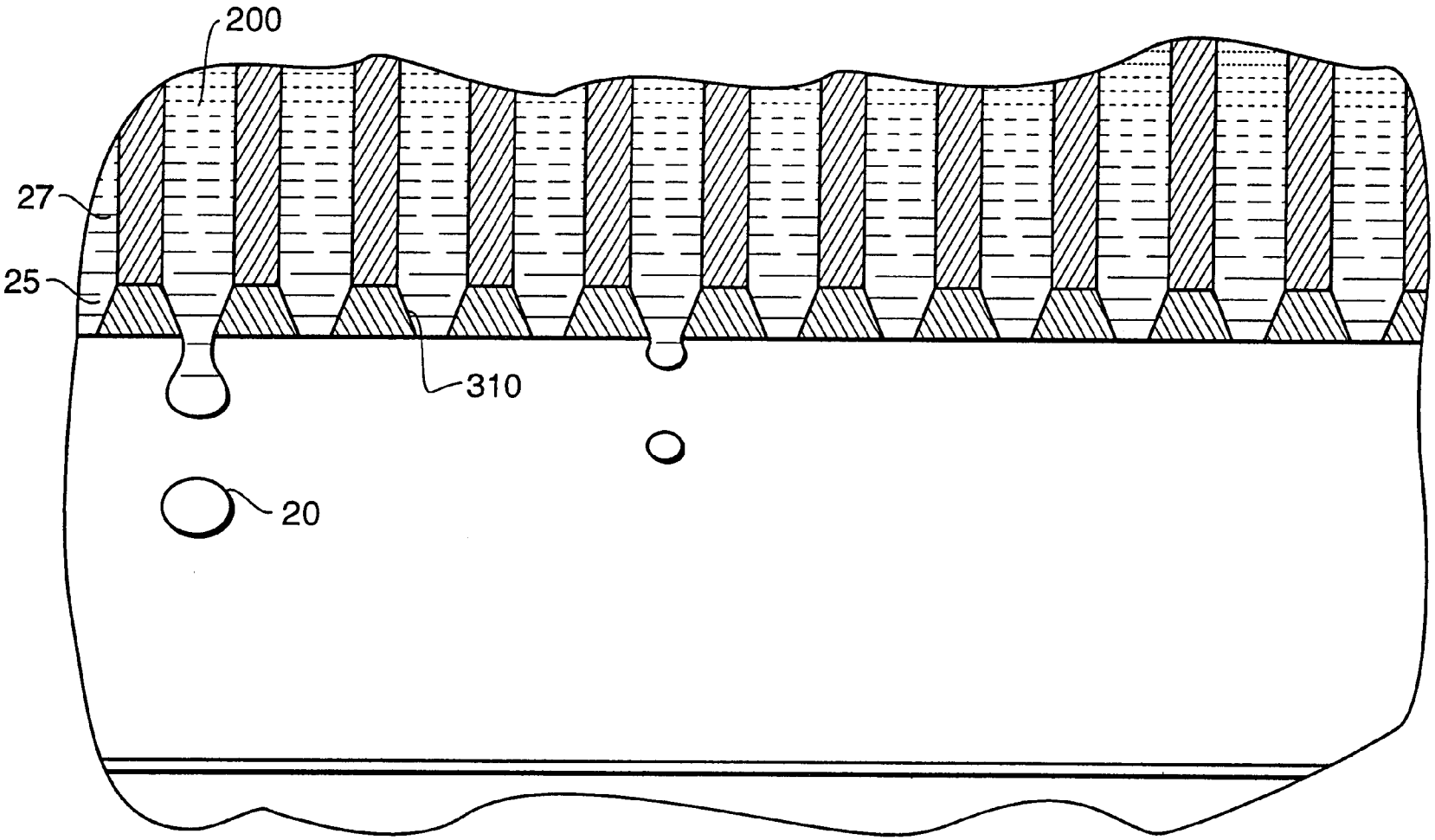
FIG. 6 is a view taken along section line 6—6 of FIG. 5.

Turning now to FIGS. 5 and 6, first embodiment nozzle plate 178, which is connected to print head body 25, includes a plurality of first nozzles 310, each first nozzle 310 having a first orifice 320 of a first diameter "$d_1$" for ejecting a plurality of ink droplets 20 therethrough. First nozzles 310 are arranged so as to define a first nozzle row 330 (as shown). Each ink droplet 20 ejected through each first orifice 320 has a first volume selected from a first dynamic range of volumes associated with each first nozzle 310 in first nozzle row 330. In addition, nozzle plate 178 includes a plurality of second nozzles 340, each second nozzle 340 having a second orifice 350 of a second diameter "$d_2$" for ejecting a plurality of ink droplets 20 therethrough. Second nozzles 340 are arranged to define a second nozzle row 360 (as shown). Each ink droplet 20 ejected through each second orifice 350 has a second volume selected from a second dynamic range of volumes associated with each second nozzle 340 in second nozzle row 360.

Still referring to FIGS. 5 and 6, it has been discovered that ranges in ink droplet volume is a function of the geometry of channel 170, number of pulses 295 in a pulse burst 290, peak voltages $+V_p$ or $-V_p$, as well as orifice diameter (i.e., $d_1$ or $d_2$). It has also been discovered that nozzle orifice diameter plays a crucial role in determining ink droplet volume. With respect to nozzle orifice diameters, a plurality (e.g., two) of nozzle diameters can be used to influence ink droplet volume which is ejected from first nozzle row 330 and second nozzle row 360. According to the invention, first nozzles 310 comprising first nozzle row 330 are capable of ejecting ink droplets 20 having volumes ranging from 1 to 16 pl (pico-litres). Also, according to the invention, second nozzles 340 comprising second nozzle row 360 are capable of ejecting ink droplets 20 having volumes ranging from 16 pl, 32 pl, 48 pl, and up to 256 pl. Therefore, second nozzles 340 possess a larger range of volumes compared to first nozzles 310. Moreover, each pair of immediately adjacent nozzles 310/340 are arranged into pixel group 370. Thus, ink droplet volumes that can be ejected by pixel group 370 range from 1 pl to 256 pl. That is, each first nozzle 310 in pixel group 370 can eject an ink droplet volume ranging from 1 to 16 pl and each second nozzle 340 in pixel group 370 can eject an ink droplet volume ranging from 16 pl, 32 pl, 48 pl, and up to 256 pl.

Figure 7:
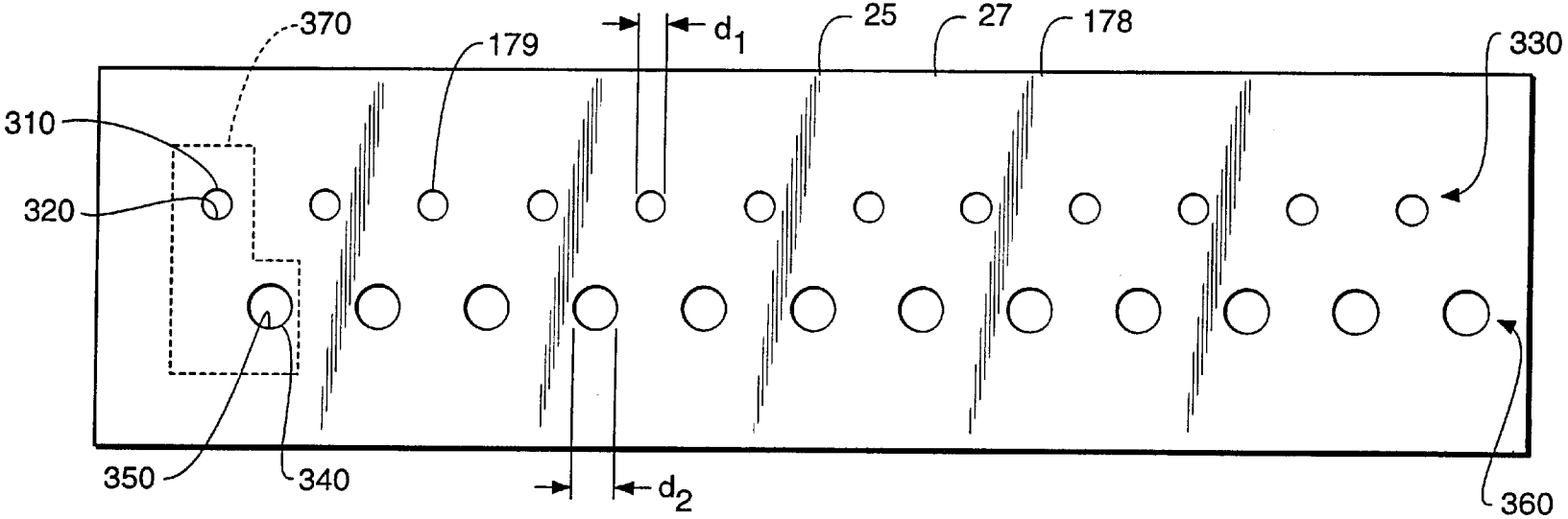
FIG. 7 is a view in elevation of a nozzle plate belonging to a second embodiment of the invention.

Referring to FIG. 7, there is shown a second embodiment print head 25 and nozzle plate 178. In this second embodiment of the invention, first nozzles 310 are staggered with respect to second nozzles 340. An advantage of this configuration of nozzle plate 178 is that staggered nozzles 310/340 can place ink droplets in one printing pass at different pixel locations, so that ink coalescence on receiver 30 is reduced.

Figure 8:
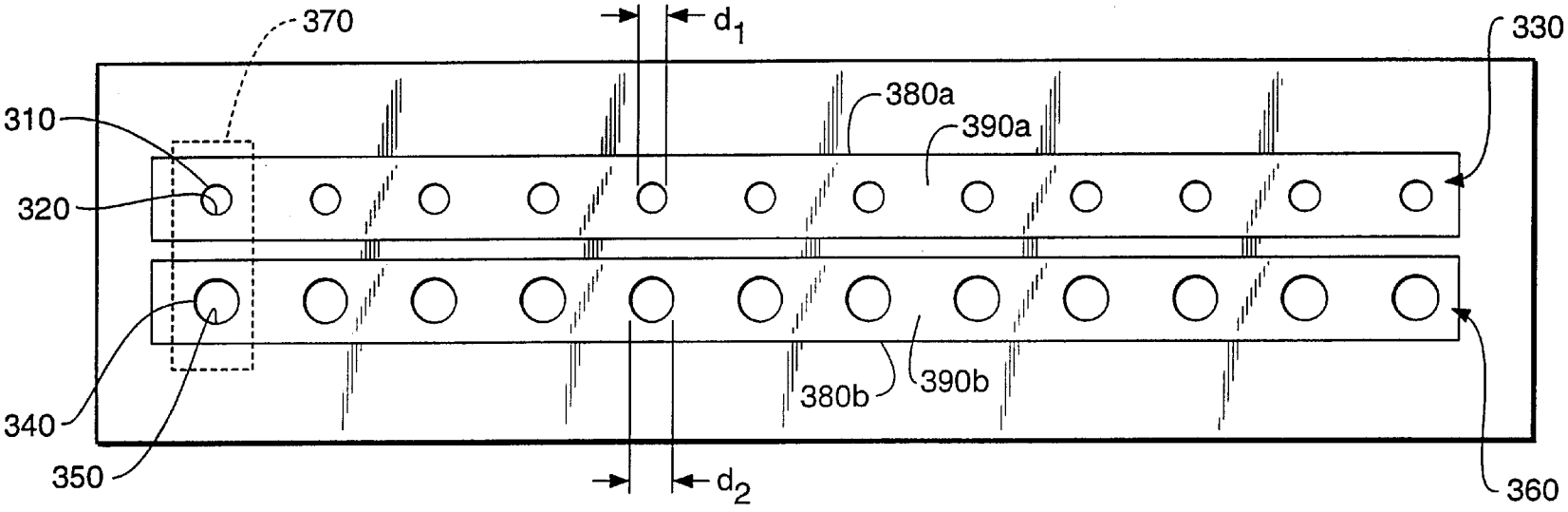
FIG. 8 is a view in elevation of a nozzle plate belonging to a third embodiment of the invention.

Referring to FIG. 8, there is shown a third embodiment of the invention comprising a first print head 380*a* and a second print head 380*b* disposed parallel to first print head 380*a*. A first nozzle plate 390*a* is connected to first print head 380*a* and a second nozzle plate 390*b* is connected to second print head 390*b*. The advantage of this configuration of the invention is the same as the advantages disclosed herein for the previously mentioned embodiments of the invention. In addition, another advantage associated with this third embodiment of the invention is enhanced flexibility of manufacturing and assembling print heads 380*a*/380*b*. In this regard, each print head 380*a*/380*b* and associated nozzle plates 390*a*/390*b* are separately manufactured. These different print heads 380*a*/380*b* can then be packaged together to form a combined print head.

It may be understood from the description herein that an advantage of the present invention is that first nozzle row 330 and second nozzle row 360 can each provides 4 bits of volume variation with respect to ink droplet volume. Thus, only the nozzles 310/340 belonging to pixel group 370 are needed to provide 8 bits of ink volume variation. This is an improvement over the prior art which requires a significantly greater number of nozzles to achieve similar results.

It may be further understood from the description herein that another advantage of the present invention is that dynamic range in ink droplet volume within each pixel group 370 is significantly larger than what is provided by prior art thermal ink jet printers. This result allows a single printer to print a single density level at 180 dpi or 16 density levels at 1440 dpi.

It may be further understood from the description herein that yet another advantage of the present invention is that print head 25 is capable of printing images at high speed and low resolution in a single bit density variation (i.e., halftone images), which is suitable for signs viewed from a relatively long distance. That is, print head 25 can print signage at 180 dpi in a single density level per pixel. Moreover, print head 25 can also print in multi-bit density levels at high resolution, which is suitable for viewing photographic quality printed images from a relatively short distance. That is, print head 25 can print photographic quality images at 1440 dpi in multiple density levels per pixel.

It also may be understood from the description herein that yet another advantage of the present invention is that when a relatively wide density range is required, enablement of all ink nozzles 310/340 in a pixel group 370 can provide maximum dynamic range in ink droplet volume.

The invention has been described in detail with particular reference to certain preferred embodiments thereof, but it will be understood that variations and modifications can be effected within the spirit and scope of the invention. For example, pulses 295 are disclosed herein as sinusoidal. However, pulses 295 may assume other shapes as well, such as square, trapezoidal or triangular or any other analog waveform.

Therefore, what is provided is a printer and print head body capable of printing in a plurality of dynamic ranges of ink volumes, and method of assembling the printer and print head.

PARTS LIST $d_1$ . . . first diameter
$d_2$ . . . second diameter
$V_p$ . . . peak voltage amplitude
$\Delta t$ . . . time delay between pulses
$T_1$ . . . full period of pulse burst
$T_1'$ . . . full period of a second pulse
$T_2$ . . . half period of pulse burst
$T_2'$ . . . half period of a second pulse
10 . . . printer
20 . . . ink droplet
25 . . . print head
27 . . . print head body
30 . . . receiver
35 . . . image
40 . . . image source
50 . . . image processor
60 . . . halftoning unit
70 . . . image memory
80 . . . pulse generator
90 . . . electrical actuator
100 . . . transport mechanism
110 . . . transport control system
120 . . . controller
130 . . . pressure regulator
135 . . . first conduit
140 . . . ink reservoir
150 . . . second conduit
160 . . . arrow
170 . . . ink channels
175 . . . channel outlet
176 . . . end of channel
177 . . . open side of channel
178 . . . nozzle plate
179 . . . orifices
180 . . . first side wall
190 . . . second side wall
200 . . . ink body
203 . . . outside surface of first side wall
205 . . . outside surface of second side wall
210 . . . base portion
220 . . . top surface
230 . . . bottom surface
240 . . . electrode actuator layer
250 . . . electrical conducting terminal
260 . . . common electrode layer
270 . . . ground potential
280 . . . cut-out
290 . . . pulse burst
295 . . . plurality of pulses
310 . . . first nozzles
320 . . . first orifice
330 . . . first nozzle row
340 . . . second nozzles
350 . . . second orifice
360 . . . second nozzle row
370 . . . pixel group
380*a* . . . first print head
380*b* . . . second print head
390*a* . . . first nozzle plate
390*b* . . . second nozzle plate

What is claimed is:

1. A printer, comprising:

(a) a print head body;

(b) a first nozzle connected to said print head body, said first nozzle having a first nozzle orifice of a first size for ejecting fluid therethrough having a first volume selected from a first dynamic range of volumes associated with said first nozzle; and (c) a second nozzle connected to said print head body, said second nozzle disposed relative to said first nozzle and having a second nozzle orifice of a second size different from the first size of the first orifice for ejecting fluid therethrough having a second volume different from the first volume, the second volume being selected from a second dynamic range of volumes associated with said second nozzle, the second dynamic range of volumes being substantially different from the first dynamic range of volumes and the first and second nozzles being co-linear or offset in an adjacent position and adapted to eject droplets of respective first and second dynamic volume ranges during printing of an image to provide an image having a dynamic range of droplet sizes that is a combination of the first and second dynamic ranges.

2. A printer capable of printing in a plurality of dynamic ranges of ink droplet volumes, comprising:

(a) a print head body;

(b) a plurality of first nozzles connected to said print head body, each first nozzle having a first orifice of a first size for ejecting an ink droplet having a first volume selected from a first dynamic range of volumes associated with each first nozzle; and (c) a plurality of second nozzles disposed co-linearly or offset relative to respective nozzles of the first nozzles and connected to said print head body, each second nozzle having a second orifice of a second size larger than the first size of said first nozzles for ejecting an ink droplet therethrough having a second volume larger than the first volume, the second volume being selected from a second dynamic range of volumes associated with each second nozzle, the second dynamic range of volumes being substantially different from the first dynamic range of volumes.

3. The printer of claim 2, (a) wherein said first nozzles are arranged to define a first nozzle row; and (b) wherein said second nozzles are arranged to define a second nozzle row adjacent the first nozzle row, such that said first nozzles defining the first nozzle row are co-linearly aligned with respective ones of said second nozzles defining the second nozzle row.

4. The printer of claim 2, (a) wherein said first nozzles are arranged to define a first nozzle row; and (b) wherein said second nozzles are arranged to define a second nozzle row adjacent the first nozzle row, such that said first nozzles defining the first nozzle row are off-set relative to respective ones of said second nozzles defining the second nozzle row.

5. A printer capable of printing in a plurality of dynamic ranges of ink droplet volumes, comprising:

(a) a plurality of first nozzles connected to said first print head body, each first nozzle having a first orifice of a first size for ejecting an ink droplet having a first volume selected from a first dynamic range of volumes associated with each first nozzle and providing 4 bits of volumes variation; and (b) a plurality of second nozzles operative in combination with the first nozzles during printing of an image, the second nozzles being, each second nozzle having a second orifice of a second size larger than the first size of said first nozzles for ejecting an ink droplet therethrough having a second volume larger than the first volume, the second volume being selected from a second dynamic range of volumes associated with each second nozzle, the second dynamic range of volumes being substantially different from the first dynamic range of volumes and providing 4 bits of volume variation so that together the printer provides eight bits of volume variation.

6. A printer capable of printing in a plurality of dynamic ranges of ink droplet volumes, comprising:

(a) a print head body having a plurality of chambers, each chamber adapted to hold an ink body therein; and (b) a nozzle plate connected to said print head body, said nozzle plate including:

(i) a plurality of first nozzles, each first nozzle having a first orifice of a first diameter for ejecting a plurality of ink droplets therethrough, each droplet having a first volume selected from a first dynamic range of volumes associated with each first nozzle; and (ii) a plurality of second nozzles, each second nozzle being disposed relative to a respective first nozzle and having a second orifice of a second diameter for ejecting a plurality of ink droplets therethrough, each droplet having a second volume larger than the first volume, the second volume being selected from a second dynamic range of volumes associated with each second nozzle, the second dynamic range of volumes being substantially greater than the first dynamic range of volumes.

7. The printer of claim 6, (a) wherein said first nozzles are arranged to define a first nozzle row; and (b) wherein said second nozzles are arranged to define a second nozzle row parallel and adjacent to the first nozzle row, so that said first nozzles defining the first nozzle row are co-linearly aligned with respective ones of said second nozzles defining the second nozzle row.

8. The printer of claim 6, (a) wherein said first nozzles are arranged to define a first nozzle row; and (b) wherein said second nozzles are arranged to define a second nozzle row parallel and adjacent to the first nozzle row, so that said first nozzles defining the first nozzle row are off-set relative to respective ones of said second nozzles defining the second nozzle row.

9. The printer of claim 6, wherein said print head body is formed of a piezoelectric material in fluid communication with the ink body in each chamber and responsive to electrical stimuli for ejecting the ink droplets from selected ones of the chambers while being electrically stimulated in order to eject the ink droplet therefrom.

10. A print head body, comprising:

(a) a first nozzle having a first nozzle orifice of a first size for ejecting fluid therethrough having a first volume selected from a first dynamic range of volumes associated with said first nozzle; and (b) a second nozzle disposed relative to said first nozzle, said second nozzle having a second nozzle orifice of a second size different from the first size of the first orifice for ejecting fluid therethrough having a second volume different from the first volume, the second volume being selected from a second dynamic range of volumes associated with said second nozzle, the second dynamic range of volumes being substantially different from the first dynamic range of volumes.

11. A print head body capable of printing in a plurality of dynamic ranges of ink droplet volumes, comprising:

(a) a plurality of first nozzles, each first nozzle having a first orifice of a first size for ejecting an ink droplet having a first volume selected from a first dynamic range of volumes associated with each first nozzle; and (b) a plurality of second nozzles, each second nozzle having a second orifice of a second size larger than the first size of said first nozzles for ejecting an ink droplet therethrough having a second volume larger than the first volume, the second volume being selected from a second dynamic range of volumes associated with each second nozzle, the second dynamic range of volumes being substantially different from the first dynamic range of volumes.

12. The print head body of claim 11, (a) wherein said first nozzles are arranged to define a first nozzle row; and (b) wherein said second nozzles are arranged to define a second nozzle row adjacent the first nozzle row, so that said first nozzles defining the first nozzle row are co-linearly aligned with respective ones of said second nozzles defining the second nozzle row.

13. The print head body of claim 11, (a) wherein said first nozzles are arranged to define a first nozzle row; and (b) wherein said second nozzles are arranged to define a second nozzle row adjacent the first nozzle row, so that said first nozzles defining the first nozzle row are off-set relative to respective ones of said second nozzles defining the second nozzle row.

14. The print head body of claim 11, wherein said first nozzles and said second nozzles are connected to respective ones of a plurality of print head bodies.

15. A print head body capable of printing in a plurality of dynamic ranges of ink droplet volumes, the print head body having a plurality of chambers, each chamber adapted to hold an ink body therein, the print head body comprising a nozzle plate, including:

(a) a plurality of first nozzles, each first nozzle having a first orifice of a first diameter for ejecting a plurality of ink droplets therethrough, each droplet having a first volume selected from a first dynamic range of volumes associated with each first nozzle; and (b) a plurality of second nozzles, each second nozzle having a second orifice of a second diameter for ejecting a plurality of ink droplets therethrough, each droplet having a second volume larger than the first volume, the second volume being selected from a second dynamic range of volumes associated with the second nozzle, the second dynamic range of volumes being greater than the first dynamic range of volume.

16. The print head body of claim 15, (a) wherein said first nozzles are arranged to define a first nozzle row; and (b) wherein said second nozzles are arranged to define a second nozzle row adjacent the first nozzle row, so that said first nozzles defining the first nozzle row are co-linearly aligned with respective ones of said second nozzles defining the second nozzle row.

17. The print head body of claim 15, (a) wherein said first nozzles are arranged to define a first nozzle row; and (b) wherein said second nozzles are arranged to define a second nozzle row adjacent the first nozzle row, so that said first nozzles defining the first nozzle row are off-set relative to respective ones of said second nozzles defining the second nozzle row.

18. The print head body of claim 15, wherein said print head body is formed of a piezoelectric material in fluid communication with the ink body in each chamber and responsive to electrical stimuli for decreasing volume of selected ones of the chambers while being electrically stimulated in order to eject the ink droplets from the chamber.

19. A method of assembling a printer, comprising the steps of:

(a) connecting a first nozzle to a print head body, the first nozzle having a first nozzle orifice of a first size for ejecting fluid therethrough having a first volume selected from a first dynamic range of volumes associated with the first nozzle; and (b) connecting a second nozzle to the print head body, the second nozzle having a second nozzle orifice of a second size different from the first size of the first orifice for ejecting fluid therethrough having a second volume different from the first volume, the second volume being selected from a second dynamic range of volumes associated with each second nozzle, the second dynamic range of volumes being substantially different from the first dynamic range of volumes.

20. A method of assembling a printer capable of printing in a plurality of dynamic ranges of ink droplet volumes, comprising the steps of:

(a) connecting a plurality of first nozzles to a print head body, each first nozzle having a first orifice of a first size for ejecting an ink droplet having a first volume selected from a first dynamic range of volumes associated with each first nozzle; and (c) connecting a plurality of second nozzles to the print head body, each second nozzle having a second orifice of a second size larger than the first size of the first nozzles for ejecting an ink droplet therethrough having a second volume larger than the first volume, the second volume being selected from a second dynamic range of volumes associated with each second nozzle, the second dynamic range of volumes being substantially different from the first dynamic range of volumes.

21. The method of claim 20, (a) wherein the step of connecting a plurality of first nozzles to the print head body comprises the step of arranging the first nozzles to define a first nozzle row; and (b) wherein the step of connecting a plurality of second nozzles to the print head comprises the step of arranging the second nozzles to define a second nozzle row adjacent the first nozzle row, such that the first nozzles defining the first nozzle row are co-linearly aligned with respective ones of the second nozzles defining the second nozzle row.

22. The method of claim 20, (a) wherein the step of connecting a plurality of first nozzles to the print head body comprises the step of arranging the first nozzles to define a first nozzle row; and (b) wherein the step of connecting a plurality of second nozzles to the print head body comprises the step of arranging the second nozzles to define a second nozzle row adjacent the first nozzle row, such that the first nozzles defining the first nozzle row are off-set relative to respective ones of the second nozzles defining the second nozzle row.

23. A method of assembly a printer capable of printing in a plurality of dynamic ranges of ink droplet volumes, comprising the steps of:

(a) disposing a second print head body relative to a first print head body;

(c) connecting a plurality of first nozzles to the first print head body, each first nozzle having a first orifice of a first size for ejecting an ink droplet having a first volume selected from a first dynamic range of volumes associated with each first nozzle; and (d) connecting a plurality of second nozzles to the second print head body, each second nozzle having a second orifice of a second size larger than the first size of the first nozzles for ejecting an ink droplet therethrough having a second volume larger than the first volume, the second volume being selected from a second dynamic range of volumes associated with each second nozzle, the second dynamic range of volumes being substantially different from the first dynamic range of volumes.

24. A method of assembling a printer capable of printing in a plurality of dynamic ranges of volumes, comprising the step of connecting a nozzle plate to a print head body having a plurality of chambers, each chamber adapted to hold an ink body ink therein, the nozzle plate including:

(i) a plurality of first nozzles, each first nozzle having a first orifice of a first diameter for ejecting a plurality of ink droplets therethrough, each droplet having a first volume selected from a first dynamic range of volumes associated with each first nozzle; and (ii) a plurality of second nozzles, each second nozzle having a second orifice of a second diameter for ejecting a plurality of ink droplets therethrough, each droplet having a second volume larger than the first volume, the second volume being selected from a second dynamic range of volumes associated with each second nozzle, the second dynamic range of volumes being greater than the first dynamic range of volumes.

25. The printer of claim 24, wherein the step of connecting a nozzle plate to a print head body comprises the steps of:

(a) arranging the first nozzles to define a first nozzle row; and (b) arranging the second nozzles to define a second nozzle row parallel and adjacent to the first nozzle row, so that the first nozzles defining the first nozzle row are co-linearly aligned with respective ones of the second nozzles defining the second nozzle row.

26. The printer of claim 24, wherein the step of connecting a nozzle plate to the print head body comprises the steps of:

(a) arranging the first nozzles to define a first nozzle row; and (b) arranging the second nozzles to define a second nozzle row parallel and adjacent to the first nozzle row, so that the first nozzles defining the first row are off-set relative to respective ones of the second nozzles defining the second row.

27. The printer of claim 24, wherein the print head body is formed of a piezoelectric material in fluid communication with the ink in each chamber and responsive to electrical stimuli for decreasing volume of selected ones of the chambers, while being electrically stimulated, in order to eject the ink droplet therefrom.

28. A method of assembling a print head body, comprising the steps of:

(a) selecting a first nozzle having a first nozzle orifice of a first size for ejecting fluid therethrough having a first volume selected from a first dynamic range of volumes associated with the first nozzle; and (b) selecting a second nozzle disposed relative to the first nozzle, the second nozzle having a second nozzle orifice of a second size different from the first size of the first orifice for ejecting fluid therethrough having a second volume different from the first volume, the second volume being selected from a second dynamic range of volumes substantially different from the first dynamic range of volumes.

29. A method of assembling a print head body capable of printing in a plurality of dynamic ranges of ink droplet volumes, comprising:

(a) selecting a plurality of first nozzles, each first nozzle having a first orifice of a first size for ejecting an ink droplet having a first volume selected from a first dynamic range of volumes associated with each first nozzle; and (b) selecting a plurality of second nozzles, each second nozzle having a second orifice of a second size larger than the first size for ejecting an ink droplet therethrough having a second volume larger than the first volume, the second volume being selected from a second dynamic range of volumes associated with each second nozzle, the second dynamic range of volumes being substantially different from the first dynamic range of volumes.

30. The method of claim 29, (a) wherein the step of selecting a plurality of first nozzles comprises the step of arranging the first nozzles to define a first nozzle row; and (b) wherein the step of selecting a plurality of second nozzles comprises the step of arranging the second nozzles to define a second nozzle row adjacent the first nozzle row, so that the first nozzles defining the first nozzle row are co-linearly aligned with respective ones of the second nozzles defining the second nozzle row.

31. The method of claim 29, (a) wherein the step of selecting a plurality of first nozzles comprises the step of arranging the first nozzles to define a first nozzle row; and (b) wherein the step of selecting a plurality of second nozzles comprises the step of arranging the second nozzles to define a second nozzle row adjacent the second nozzle row, so that the first nozzles defining the first nozzle row are off-set relative to respective ones of the second nozzles defining the second nozzle row.

32. The method of claim 29, wherein the first nozzles and the second nozzles are connected to respective ones of a plurality of print head bodies.

33. A method of assembling a print head body capable of printing in a plurality of dynamic ranges of ink droplet volumes, the print head body having a plurality of chambers, each chamber adapted to hold an ink body therein, the method comprising the step of providing a nozzle plate, the nozzle plate including:

(a) a plurality of first nozzles, each first nozzle having a first orifice of a first diameter for ejecting a plurality of ink droplets therethrough, each droplet having a first volume selected from a first dynamic range of volumes associated with each first nozzle; and (b) a plurality of second nozzles, each second nozzle having a second orifice of a second diameter for ejecting a plurality of ink droplets therethrough, each droplet having a second volume larger than the first volume selected from a second dynamic range of volumes associated with each second nozzle, the second dynamic range of volumes being generally greater than the first dynamic range of volume.

34. The method of claim 33, wherein the step of providing a nozzle plate, comprises the steps of:

(a) arranging the first nozzles to define a first nozzle row; and (b) arranging the second nozzles to define a second nozzle row adjacent the first nozzle row, so that the first nozzles defining the first nozzle row are co-linearly aligned with respective ones of the second nozzles defining the second nozzle row.

35. The method of claim 33, wherein the step of providing a nozzle plate comprises the steps of:

(a) arranging the first nozzles to define a first nozzle row; and (b) arranging the second nozzles to define a second nozzle row adjacent the second nozzle row, so that the first nozzles defining the first nozzle row are off-set relative to respective ones of the second nozzles defining the second nozzle row.

36. The method of claim 33, further comprising the step of coupling each of the first and second nozzles to a transducer formed of a piezoelectric material in fluid communication with the ink body in each chamber for decreasing volume of selected ones of the chambers in order to separate the ink droplets from the ink body and eject the ink droplets from the chamber.

* * * * *